United States Patent [19]

Hubbard

[11] Patent Number: 4,829,816

[45] Date of Patent: May 16, 1989

[54] METHOD AND APPARATUS FOR TESTING SPOTTING FLUIDS FOR RELEASING STUCK DRILL PIPE

[75] Inventor: Jason C. Hubbard, The Colony, Tex.

[73] Assignee: Standard Oil Production Company, Houston, Tex.

[21] Appl. No.: 118,095

[22] Filed: Nov. 6, 1987

[51] Int. Cl.[4] ..... E21B 47/00

[52] U.S. Cl. ..... 73/151; 73/61.4; 166/301

[58] Field of Search ..... 73/151, 153, 61.4, 64.4, 73/865.6; 166/301; 175/40, 65

[56] References Cited

U.S. PATENT DOCUMENTS

| | | | |
|---|---|---|---|
| 1,960,224 | 5/1934 | Schoenberg | 73/64.4 |
| 2,372,575 | 3/1945 | Hayward | 166/301 |
| 3,104,707 | 9/1963 | Overly | 166/301 |
| 3,126,970 | 3/1964 | Rygg | 175/57 |
| 3,415,109 | 12/1968 | Sucker et al. | 73/64.4 |
| 3,780,569 | 12/1973 | Graham | 73/64.4 |
| 4,458,528 | 7/1984 | Roper et al. | 73/151 |
| 4,466,486 | 8/1984 | Walker | 166/301 |
| 4,491,181 | 1/1985 | Krol | 166/301 |
| 4,494,610 | 1/1986 | Walker | 166/301 |
| 4,548,080 | 10/1985 | Sweet | 73/61.4 X |
| 4,614,235 | 9/1986 | Keener et al. | 166/301 |

FOREIGN PATENT DOCUMENTS

| | | | |
|---|---|---|---|
| 0135747 | 7/1985 | Japan | 73/64.4 |

OTHER PUBLICATIONS

Bond et al., "An Improved App. for Interfacial Tension Meas. by the Ring Method", Rev. Sci. Instrum., vol. 44, No. 6, Jun. 1973, p. 779.

*Primary Examiner*—Eugene R. LaRoche
*Assistant Examiner*—Seung Ham
*Attorney, Agent, or Firm*—Raymondm F. Keller; David J. Untener; Larry W. Evans

[57] ABSTRACT

An apparatus and method for testing the performance of spotting fluids used for freeing drill pipe stuck to drilling mud filter cake in a borehole. A small cylinder simulating the drill pipe is pressed against a filter cake in a vessel. Spotting fluid is applied and the cylinder and cake are pulled apart. The maximum force required to free the cylinder is recorded.

13 Claims, 1 Drawing Sheet

METHOD AND APPARATUS FOR TESTING SPOTTING FLUIDS FOR RELEASING STUCK DRILL PIPE

BACKGROUND OF THE INVENTION

1. Field of the Invention

This invention relates to a method and apparatus for testing the efficacy of spotting fluids used for releasing drill pipe which has become stuck during the drilling of a borehole.

2. Discussion of the Art

During the drilling of oil and gas wells, a drilling fluid or "mud" is pumped to the bottom of the well through the hollow drill pipe. Drilling mud cools the drill bit and serves to transport the rock cuttings to the top of the well through the annulus between the drill pipe and the borehole wall. Under some conditions this mud can also form a filter cake on the walls of the borehole, particularly in more permeable rock formations.

The drill pipe can occasionally become stuck to the filter cake, making rotation or removal of the pipe difficult or impossible. When this happens, chemicals known as spotting fluids can be pumped down the drill pipe into the annulus in attempts to free the stuck pipe from the cake.

Many types of spotting fluids are commercially available from well service and supply companies. Choosing an appropriate spotting fluid, however, is not easy because not all fluids are equally effective to release the pipe from the particular filter cake that has resulted from the specific combination of mud types and rock formations in a borehole. The driller has the option of and rock formations in a borehole. The driller has the option of choosing a fluid based upon the driller's past experience, the fluid supplier's recommendations, or a blind guess. These trial and error methods can be expensive due to the high cost of these chemicals.

A second option has been to reproduce the stuck pipe conditions in a laboratory using sections of drill pipe and drilling mud. Candidate spotting fluids are tested to determine which is the most effective. However, such full scale test equipment is expensive and can require a full day for a single test. The expense of idle drilling rigs has driven the search for a simple apparatus and technique that can quickly predict the behavior of one or more spotting fluids when a drill pipe becomes stuck.

SUMMARY OF THE INVENTION

The present invention is an improved apparatus and method for quickly determining the efficacy of a selected spotting fluid or releasing stuck drill pipe. The apparatus comprises an open vessel containing a drilling mud filter cake, a small cylinder simulating the drill pipe with at least a portion of its outer surface adhering to the filter cake and with its axis oriented parallel to the surface of the filter cake, a spotting fluid applied to the filter cake surrounding the cylinder, a means for applying a force perpendicular to the axis of the cylinder to separate the cylinder from the cake, and a means for concurrently measuring and recording the force required to separate the cylinder from the filter cake. In the inventive method, the cylinder is pulled from the filter cake while the force required for separation is recorded.

DESCRIPTION OF THE PREFERRED EMBODIMENTS

Figure 1:
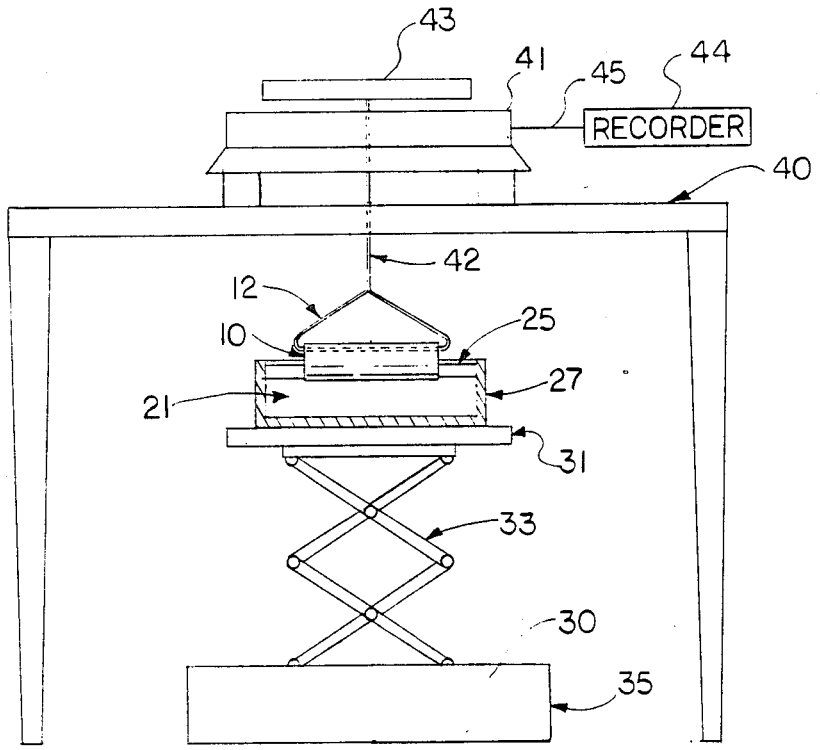
FIG. 1 is a cross-section of a preferred embodiment of the apparatus. A vessel supported on a jack platform contains a glass cylinder stuck to a filter cake. A mass balance attached to the cylinder measures the force applied when the jack is lowered.

This invention describes a method and a device suitable for reproducing the conditions under which a drill pipe has become stuck to a filter cake, and for quantitatively determining the relative amount of force required to free the pipe when selected spotting agents are used.

The apparatus requires an open vessel or container for holding the filter cake formed from drilling mud. Preferably this vessel is the same one used for forming the filter cake, to avoid the need to transfer and disturb the cake once it has been formed. Accordingly, conventional vessels such as API fluid loss cells, vacuum funnels, and the like are preferred. The filter cake is typically formed by differential pressure (vacuum or overburden) to separate the cake from the filtrate, which can be discarded.

To simulate the drill pipe, a cylinder of glass, metal, or other relatively non-porous material can be used. Open tubes are preferred because they can be easily attached to wires, but solid cylinders or closed tubes can also be used. The cylinder is placed on the top surface of the filter cake so that it becomes stuck to the cake, with its axis substantially parallel to the surface of the cake. If desired, the cylinder can be pressed against the cake for better adhesion.

A means for applying a force to the cylinder in a perpendicular direction away from the cake is also required. This can be achieved by a wire passing through the tube, a clamp around the exposed surface of the cylinder, a hook on the ends, a wire or rod bonded to the surface, or similar means. The wire or rod from the cylinder is then attached to the measuring means or, alternatively, the separating means. During the test procedure the cylinder can be lifted from the cake while the cake remains stationary, or vice versa, or both the cylinder and cake can move in opposite directions. The motive force to separate the cylinder from the cake can be supplied by hand or by any number of mechanical devices. Most preferred are devices such as motor-driven jacks or winches which provide a steady force and movement.

In a preferred embodiment, the wire with the attached cylinder is connected to a balance situated above the cylinder. A motor-driven jack is used to lower the vessel and thus cause the filter cake and cylinder to separate.

To quantitatively determine the force required for separation and to record that force for later comparison with other samples tested, a means for concurrently measuring and recording the force is employed. A steadily increasing force is applied until the separation occurs, but only the maximum force need be determined and recorded. A balance coupled with a recorder which displays the measured force at frequent intervals can be used. Preferably the recorder is capable of continuous recording over time so that the exact peak force can be determined. A balance which will record and hold a display of only the peak force measured is most preferred.

Before the cylinder is separated from the cake, a selected spotting fluid is applied to the filter cake. The amount should be sufficient to completely surround the cylinder, with excess amounts preferred.

The invention can be demonstrated by the following examples.

EXAMPLE 1

Referring to FIG. 1, a filter cake 21 was formed in a conventional API Fluid Loss Cell 27, a metal cup about two inches in diameter and about the same height, which is well known in the art. The cell was filled with approximately 325 cc of 12.0 ppg water base drilling mud and a overburden nitrogen pressure of 100 psi was applied for 7.5 minutes. Excess mud was decanted from the cell 27, leaving the filter cake 21 undisturbed.

A glass tube 10 having a diameter of 2.8 cm and a length of 5.0 cm was chosen to simulate drill pipe. The tube was then filled with shale to reduce the buoyancy of the tube and to prevent the filter cake and spotting fluid from entering the open ends of the tube. A strand of copper wire 12 was pushed through the tube to provide a means for lifting the tube.

The tube 10 was then placed on top of the cake 21 and pressure was again applied for two minutes at 100 psi to ensure that the glass tube adhered to the filter cake. The tube 10 was then covered with 130 cc of a spotting fluid 25 coded "A". Pressure was applied at 100 psi for thirty minutes, after which the excess spotting fluid and drilling mud was removed from the cell without disturbing the glass tube 10 or the filter cake 21.

The bottom of cell 27 was attached to the platform 31 of a JIFFY JACK (TM) scissors jack 30, which also comprised a base 35 containing an electric motor (not shown) for driving the jack arms 33. The jack 30 was then placed beneath a support stand 40 containing a METTLER Model PM300 Balance 41. A wire 42 was attached to the underside of the balance plate 43 and also to the wire 12 attached to tube 10. The balance 41 was connected to a METTLER Model GA44 Printer 44 by connection 45.

After activating the printer 44, the jack 30 was activated, causing platform 31 containing the filter jack cake to lower and pull away from the tube 10, which was attached to the balance plate 41. The printer recorded at 0.7 second intervals the force (measured in grams) required to separate the glass tube from the filter cake. The maximum force recorded was 138 g. This value was 25 percent less than the force required to pull the tube from a "blank" preparation which contained no spotting fluid: 184 g.

EXAMPLES 2–12

The procedure described in Example 1 was repeated using a different spotting fluid composition in each example. Three samples were tested for each example, and the results were averaged. In comparisons as shown in Table I, the tests were generally reproducible in terms of percent differences in force measured when using a particular spotting fluid versus no spotting fluid.

TABLE I

EFFICACY OF SPOTTING FLUIDS

| Example | Spotting Fluid | Force to Pull Free (9) | Percent Reduction |
|---|---|---|---|
| Blank | None | 184 | — |
| 1. | A | 138 | 25 |

TABLE I-continued

EFFICACY OF SPOTTING FLUIDS

| Example | Spotting Fluid | Force to Pull Free (9) | Percent Reduction |
|---|---|---|---|
| 2. | B | 118 | 36 |
| 3. | C | 94 | 46 |
| 4. | D | 107 | 42 |
| 5. | E | 81 | 56 |
| 6. | F | 142 | 23 |
| 7. | G | 125 | 32 |
| 8. | H | 90 | 51 |
| 9. | I | 218 | (18) |
| 10. | J | 145 | 21 |
| 11. | K | 100 | 46 |
| 12. | L | 187 | (1) |

I claim:

1. An apparatus for determining the efficacy of a spotting fluid intended to release a drill pipe which has become stuck within a borehole, the apparatus comprising:

(a) an open vessel containing a drilling mud filter cake, which cake has a top surface;

(b) a cylinder having an outer surface with at least a portion of said outer surface adhering to the cake and said cylinder having the axis thereof oriented parallel to the surface of the cake;

(c) a spotting fluid applied to the cake surrounding the cylinder;

(d) a means for applying a force perpendicular to the axis of the cylinder to separate the cylinder from the cake; and (e) a means for concurrently measuring and recording the force required to separate the cylinder from the cake.

2. The apparatus of claim 1 in which the means for applying the force consists of a motor-driven jack.

3. The apparatus of claim 1 in which the vessel is a vacuum funnel.

4. The apparatus of claim 1 in which the vessel is an API fluid loss cell.

5. The apparatus of claim 1 in which the measuring and recording means is a mass balance coupled with a recorder capable of displaying the maximum force measured by the balance.

6. The apparatus of claim 1 in which the cylinder is a hollow tube.

7. The apparatus of claim 1 in which the cylinder is connected to a balance situated above the cylinder, and the vessel is connected to the platform of a motor driven jack.

8. The apparatus of claim 7 in which the vessel consists of an API fluid loss cell.

9. The apparatus of claim 8 in which the cylinder is a glass tube.

10. The apparatus of claim 9 in which a separate recorder is connected to the balance.

11. A method for determining the efficacy of a spotting fluid used to release a drill pipe which has become stuck within a borehole, the method comprising:

(a) forming a drilling mud filter cake within an open vessel, the cake having a top surface, (b) placing a cylinder on the cake with the cylinder's axis parallel to the surface of the cake and with at least a portion of the outer surface of the cylinder adhering to the cake, (c) applying a spotting fluid to the cake surrounding the cylinder (d) separating the cylinder from the cake, and (e) concurrently measuring and recoding the force required to separate the cylinder and cake.

12. The method of claim 11 in which the cake is formed in an API fluid loss cell, the cylinder is a glass tube having a wire passing through it to support the tube, the force of separation is measured by attaching said wire to a balance situated above the cylinder, and the cylinder is separated from the cake by lowering the cell.

13. The method of claim 12 in which the tube is pressed against the surface of the cake by sealing the fluid loss cell and applying pressure.

* * * * *